US005349316A

United States Patent [19]

Sterns

[11] Patent Number: 5,349,316

[45] Date of Patent: Sep. 20, 1994

[54] DUAL BANDPASS MICROWAVE FILTER

[75] Inventor: William G. Sterns, West Hills, Calif.

[73] Assignee: ITT Corporation, New York, N.Y.

[21] Appl. No.: 44,409

[22] Filed: Apr. 8, 1993

[51] Int. Cl.[5] ..... H01P 1/208

[52] U.S. Cl. ..... 333/208; 333/209; 333/212; 333/135

[58] Field of Search ..... 333/208–212, 333/227–232, 21 R, 126, 129, 135

[56] References Cited

U.S. PATENT DOCUMENTS

| | | | |
|---|---|---|---|
| 2,890,421 | 6/1959 | Currie | 333/208 |
| 3,697,898 | 10/1972 | Blachier et al. | 333/209 X |
| 5,012,211 | 4/1991 | Young et al. | 333/212 |

OTHER PUBLICATIONS

By: A. E. Atia and A. E. Williams; "Nonminimum--Phase Optimum-Amplitude Bandpass Waveguide Filers", Apr. 4, 1974, pp. 425–431.

By: D. A. Taggart and R. D. Wanselow; "Mixed Mode Filters", Oct. 10, 1974, pp. 898–902.

By: A. E. Williams and A. E. Atia; "Dual Mode Canonical Waveguide Filters", Dec. 12, 1977, pp. 1021–1026.

By: U. Rosenberg and D. Wolk; "Filter Design Using In-Line Triple-Mode Cavities and Novel Iris Couplings", Dec. 12, 1989, pp. 2011–2019.

*Primary Examiner*—Seungsook Ham

*Attorney, Agent, or Firm*—Arthur L. Plevy; Thomas L. Peterson

[57] ABSTRACT

A two port dual bandpass microwave filter consisting of "n" resonant cavities. Each cavity resonates in two independent modes at displaced frequencies so that the filter has two passbands in a desired frequency band. By orienting an incoming waveguide at an angle with respect to the filter, both TE and TM modes can be excited to produce two separate passbands. The passbands may have either equal or unequal characteristics. Fine tuning of the TE and TM modes is accomplished using tuning plungers or tuning screws. The dual bandpass response of the new filter is achieved by utilizing the $TE_{1,1,1}$ and $TM_{0,1,0}$ modes in right circular cylindrical cavities, or equivalent modes in rectangular, or other cavities. These modes are orthogonal so they do not couple to each other. The cavity loaded Qs are independently adjustable, so the two passbands can have the same or different bandwidths, the same or different amplitude ripples and the same or different phase responses. The dual bandpass microwave filter provides filtering with but one set of cavity resonators rather than two. It does not require three port microwave junctions with critical path lengths. The filter is well-suited to filter the output of a single transmitter capable of operation at two differential frequencies.

20 Claims, 9 Drawing Sheets

DUAL BANDPASS MICROWAVE FILTER

FIELD OF THE INVENTION

The present invention generally relates to waveguide filters of the type using dual mode cavities, and more particularly to filters which produce dual bandpass transfer functions with a single set of resonant cavities.

BACKGROUND OF THE INVENTION

An electrical filter is a two-port circuit that has a desired specified response to a given input signal. Many filters are used to allow certain frequencies to be transmitted to an output load while rejecting the remaining frequencies. The use of low pass, high pass and bandpass filters in microwave systems is well-known to separate frequency components of a complex wave. For instance, microwave filters are commonly used in transmit paths to suppress spurious radiation or in the receive paths to suppress spurious interference.

The design of microwave filter circuitry is complicated by the fact that conventional electronic components do not retain their basic electric properties when operated at microwave frequencies. Thus, specialized electric circuit techniques which exploit both the electric and magnetic properties of the wave are commonly employed. For example, the conductors which carry microwave signals between components often take the form of waveguides. Waveguides are guided field structures commonly having either rectangular or circular cross sections, usually constructed of a highly conductive material and to a high degree of precision. The effects of capacitance and inductance are introduced into guided field structures through which the microwave signals pass by sitting posts, stubs, annuli and so on. The physical dimensions of these devices and their position in relation to the guided field structure determine the type of effect they are to produce. One such effect would be the passage of only a desired microwave signal band through the waveguide to realize a bandpass filter.

Waveguide filters may operate in a single mode or may be of a multi-mode type. With the multi-mode filters of previous designs, the existing modes are synchronously tuned to augment the performance of filters with a single passband. Two of the earliest descriptions of a two mode filter is set forth in an article by Ragan, entitled "Microwave Transmission Circuits", Volume 9 of the *Radiation Laboratory Series*, McGraw Hill, 1948, pp 673–679, and an article by Wei-guan Lin, entitled "Microwave Filters Employing a Single Cavity Excited in more than One Mode", *Journal of Applied Physics*, Vol. 22, No. 8, August 1951, pp. 989–1001, wherein a five mode single cavity filter is described.

Many other articles about multi-mode filters, with a single passband, have appeared in the literature, including: "Nonminimum-Phase Optimum-Amplitude Bandpass Waveguide Filters", A. E. Atia and A. E. Williams, *IEEE Transactions on Microwave Theory and Techniques*, Vol. MTT-22, No. 4, April 1974, pp. 425–431; "Mixed Mode Filters", D. A. Taggart and R. D. Wanselow, *IEEE Transactions on Microwave Theory and Techniques*, Vol. MTT-22, No. 10, October 1974, pp. 898–902; "Dual Mode Canonical Waveguide Filters", A. E. Williams and A. E. Atia, *IEEE Transactions on Microwave Theory and Techniques*, Vol. MTT-25, No. 12, December 1977, pp. 1021–1026; and "Filter Design Using In-Line Triple-Mode Cavities and Novel Iris Couplings", U. Rosenberg and D. Wolk, *IEEE Transactions on Microwave Theory and Techniques*, Vol. MTT-37, No. 12, December 1989, pp. 2011–2019.

All of the filters described above have the common characteristic of having a single passband. Such filters are useful to filter the output of a transmitter which outputs a single frequency, however, when these filters are employed with transmitters that generate more than one frequency, the design becomes more complicated.

Referring to FIG. 1, there is shown a conventional prior art two frequency system 10 that employs two transmitters 12, 14 and a three port diplexer 20 to combine their outputs. The first transmitter 12 is coupled to the first filter 16 via microwave path D and the second transmitter 14 is coupled to the second filter 18 via microwave path C. The microwave paths will most likely be in the form of waveguides, which as discussed, are well-known in the art. The first filter 16 is coupled to one input of the diplexer 20 via microwave path A and the second filter 18 is coupled to the other input of the diplexer 20 via microwave path B. The lengths of the microwave paths C, D which couple the transmitters 12, 14 to their respective filters 16, 18 are not considered critical with regard to the operating frequencies of the transmitters 12, 14. On the other hand, the lengths of the microwave paths A, B, which emanate from the filters 16, 18 to the inputs of the diplexer 20 are critical. That is, exact phase lengths of the paths A, B must be established and maintained for proper operation of the system 10. If the operating frequencies of either, or both transmitters 12, 14 are changed, then either the length of path A, path B or both paths A and B must be changed.

When two frequencies are generated by a common source, the design of an output filter system using conventional techniques is more complex than a single frequency system. Referring to FIG. 2, there is shown prior art of an output filter system 22 which receives two frequencies of microwave signals generated from a common source (not shown). As can be seen, the filter system 22 employs two three port junctions 24, 25 for transporting the RF energy to and from the first filter 26 and the second filter 28. The filter system 22 of FIG. 2 contains four critical length microwave paths E, F, G, H. Paths E and F connect the first filter 26 with the first and second three port junctions 24, 25, respectively. Paths G and H connect the input and output of the second filter 28 to the respective three port junctions 24, 25. Exact phase lengths of each path E, F, G, H must be established and maintained for proper operation of the filter system 22. Thus, if either frequency in the system 22 needs to be changed, then two of the four path lengths must be modified. If both frequencies are changed, then, all of the path lengths E, F, G, H will also require modification.

It is therefore an object of the present invention dual passband microwave filter to provide a single structure microwave filter without the critical path lengths that require modification when frequencies are altered.

It is further objective of the present invention dual bandpass microwave filter to provide a dual bandpass filter that has a simpler structure, reduced size and lower cost structure than comparable prior art filters.

SUMMARY OF THE INVENTION

A microwave bandpass filter used in conjunction with a waveguide, wherein the waveguide travels in a single distinct plane. The filter is selectively oriented with respect to the plane to determine a desired frequency response. The filter includes at least one resonant cavity having at least two independent modes of propagation. Each cavity includes first and second ports for transfer of energy therebetween. Each cavity is dimensioned to resonate in the independent modes at displaced frequencies. The ports are adapted to receive the waveguide at a predetermined angle of inclination in respect to the plane of the waveguide so that two orthogonal modes are excited in the cavities. The cavities include tuning plungers or tuning screws for adjusting the resonant frequencies of the modes.

The dual bandpass response of the new filter is achieved by utilizing the $TE_{1,1,1}$ and $TM_{0,1,0}$ modes in right circular cylindrical cavities, or equivalent modes in rectangular, or other cavities. These modes are orthogonal so they do not couple to each other. The cavity loaded Qs are independently adjustable, so the two passbands can have the same or different bandwidths, the same or different amplitude ripples and the same or different phase responses.

The dual bandpass microwave filter provides filtering with one set of cavity resonators rather than two. It does not require three port microwave junctions with critical path lengths. The filter can be used to filter the outputs of a single transmitter that operates at two different frequencies.

BRIEF DESCRIPTION OF THE DRAWINGS

For a better understanding of the present invention, reference is made to the following description of exemplary embodiment thereof, considered in conjunction with the accompanying drawings, in which.

DETAILED DESCRIPTION OF THE DRAWINGS

Figure 1:
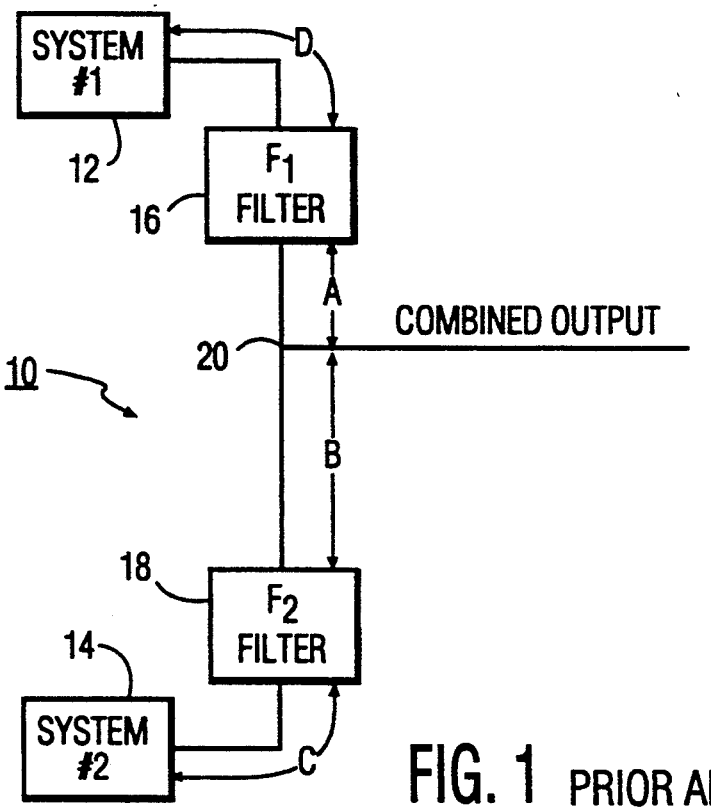
FIG. 1 PRIOR ART
FIG. 1 is a block diagram of a prior art microwave filter system employing three port diplexer to combine the filtered outputs of two transmitters operating at different frequencies.
Figure 2:
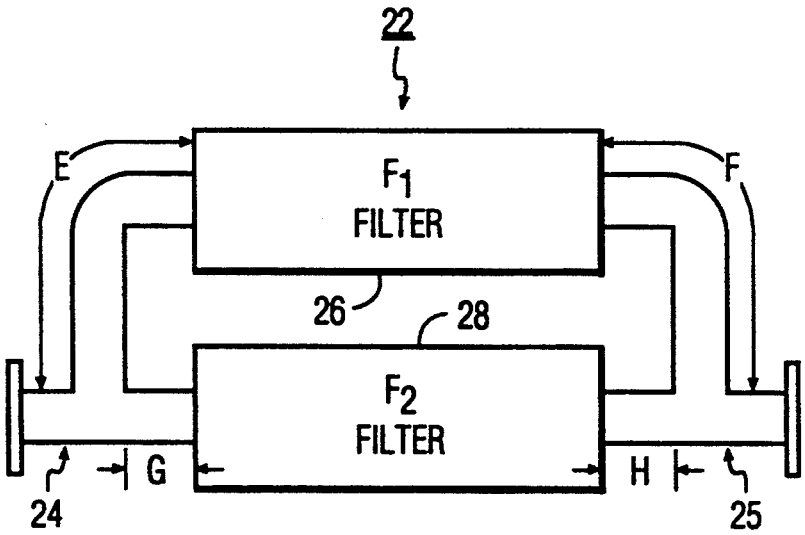
FIG. 2 PRIOR ART
FIG. 2 is generalization of a prior art dual bandpass microwave filter for use with a dual frequency transmitter.
Figure 3:
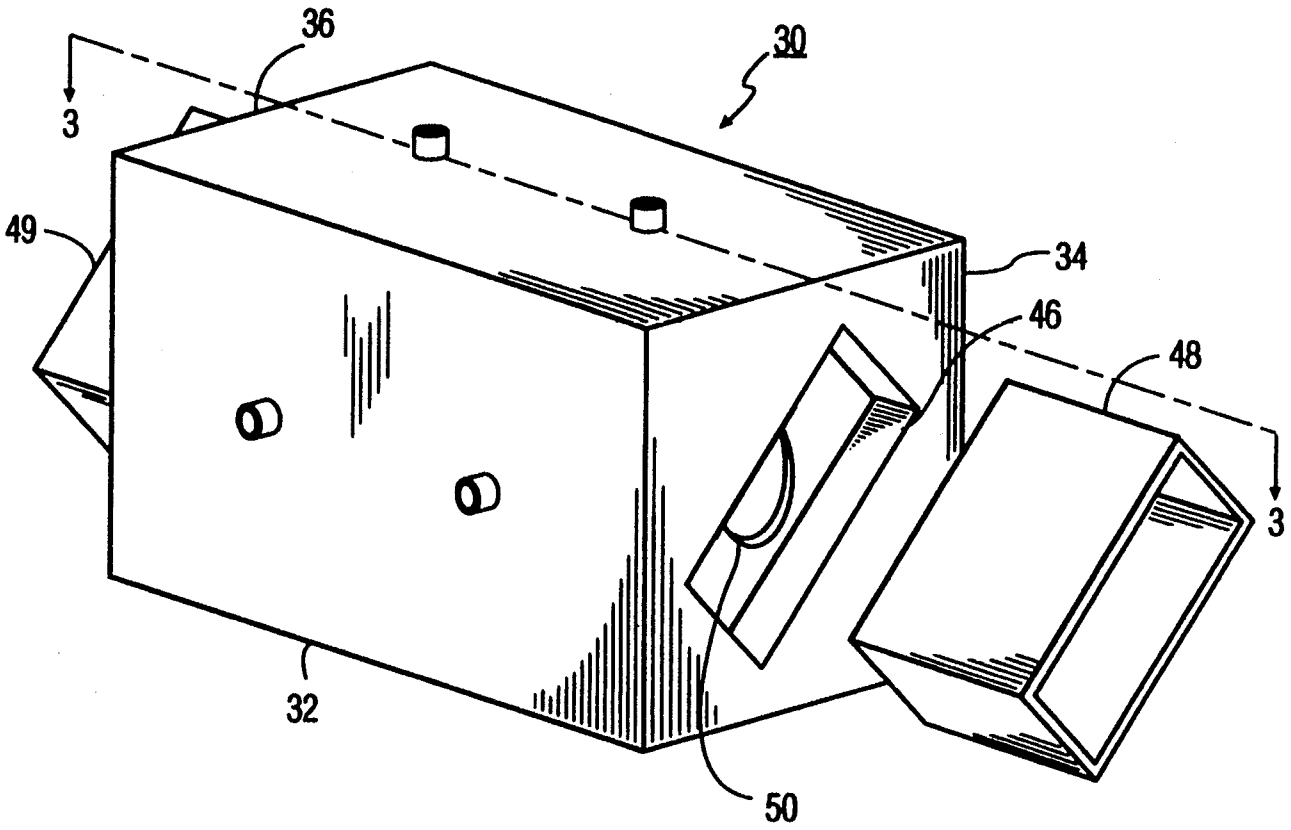
FIG. 3 is a perspective view of one preferred embodiment of the present invention dual bandpass microwave filter, wherein a two section filter is shown.

Referring to FIG. 3, there is shown one preferred embodiment of a dual passband microwave filter 30 according to the present invention. The filter 30 generally comprises a resonator housing 32 having an input end 34 and an output end 36. A waveguide 48 is coupled to the filter 30. Although the waveguide 48 can be any guided field structure, in the shown embodiment the waveguide 48 is a rectangular waveguide. A waveguide port 46 is disposed on the input end 34 of the filter 30. The waveguide port 46 interconnects with the incoming waveguide 48, thereby joining the filter 30 to the waveguide structure. Similarly, another waveguide port (not shown) is disposed on the output end 36 of the filter 30, wherein the waveguide port interconnects the filter 30 with the outgoing waveguide 49. The waveguides 48 and 49 are oriented at an angle relative to the body of the filter 30, so the dominant waveguide mode will couple to both the TE and TM modes in the resonators. While a two section filter 30 is shown, it will be understood that the filter 30 of FIG. 3 is representative of an "n" section filter, wherein "n" is any positive integer and is determined by the performance of the filter.

Figure 4:
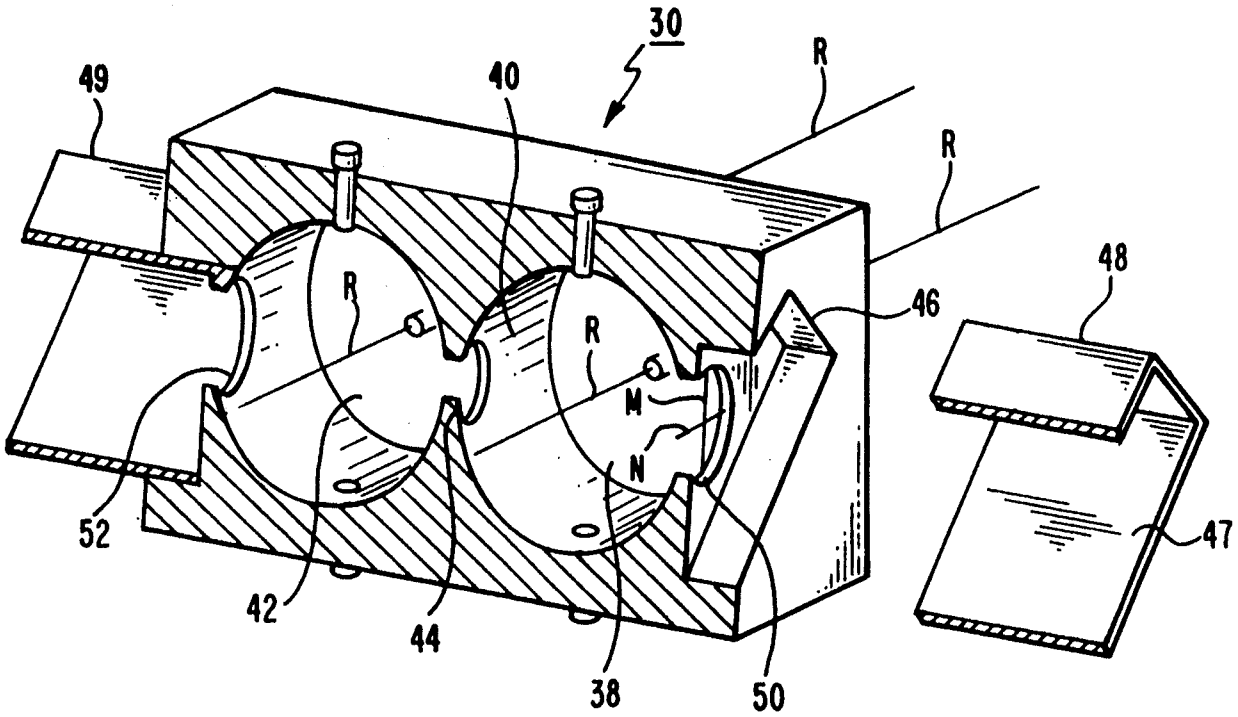
FIG. 4 is a sectioned perspective view of the present invention two section dual bandpass microwave filter viewed along section line 3—3.

A sectioned view of the filter 30 is shown in FIG. 4. In the shown embodiment, the filter 30 has two electrically conductive cylindrical resonator cavities, 38, 42, with a common center wall 40. Microwave energy traveling through the incoming waveguide 48 enters the first cavity 38 of the filter 30 through an input coupling aperture 50. The input coupling aperture 50 is generally elliptical in shape because the coupling factors from rectangular waveguides 48, 49 are different for the TE and TM modes in the cavities. If it is desired to have identical frequency responses for the two pass bands, the major axis M of the elliptical coupling aperture 50 is perpendicular to the cylindrical resonator axis R, and the minor axis N of the coupling aperture 50 is parallel to the cylindrical resonator axis R. Within the filter 30, microwave energy passes from the first cavity 38 to the second cavity 42 (and then to the next cavity in an "n" section filter) through an inter-stage aperture 44 that is disposed in the common wall(s) 40. The inter-stage aperture 44 is also generally elliptical, having a major axis perpendicular to the cylindrical resonator axis R, and the minor axis parallel to the cylindrical resonator axis R for identical frequency responses for the two pass bands. Microwave energy exits the second cavity, or the last cavity in an "n" section filter, and enters the outgoing waveguide 49 through the output coupling aperture 52. The output coupling aperture 52 is also generally elliptical in shape, and is generally the same as the input coupling aperture 50.

It is noted that circular input and output apertures 50, 52 can be used, when identical frequency responses are desired, if the orientation of the input and output waveguides 48, 49 is properly selected. If the broad wall 47 of the waveguide 48 is perpendicular to the axis R of the cylindrical resonator cavities 38, 42, then only the TM mode is excited in the resonator. If the broad wall 47 of the waveguide 48 is parallel to the axis R of the cylindrical resonator cavities 38, 42, then only the TE mode is excited in the resonator. For equal filter responses, the interstage aperture(s) 44 must always be elliptical. It is also noted that other aperture shapes, such as crossed slots, may be used, and that these apertures do not have to be elliptical or circular.

The filter 30 of FIG. 3 utilizes a recessed waveguide port 46 for accepting the incoming and outgoing waveguides 48, 49. It will be understood that the use of a recessed port is not necessary for the operation of the filter 30. As such, the filter 30 may include flange connections or any other known means for coupling a filter to a guided wave structure.

Figure 5:
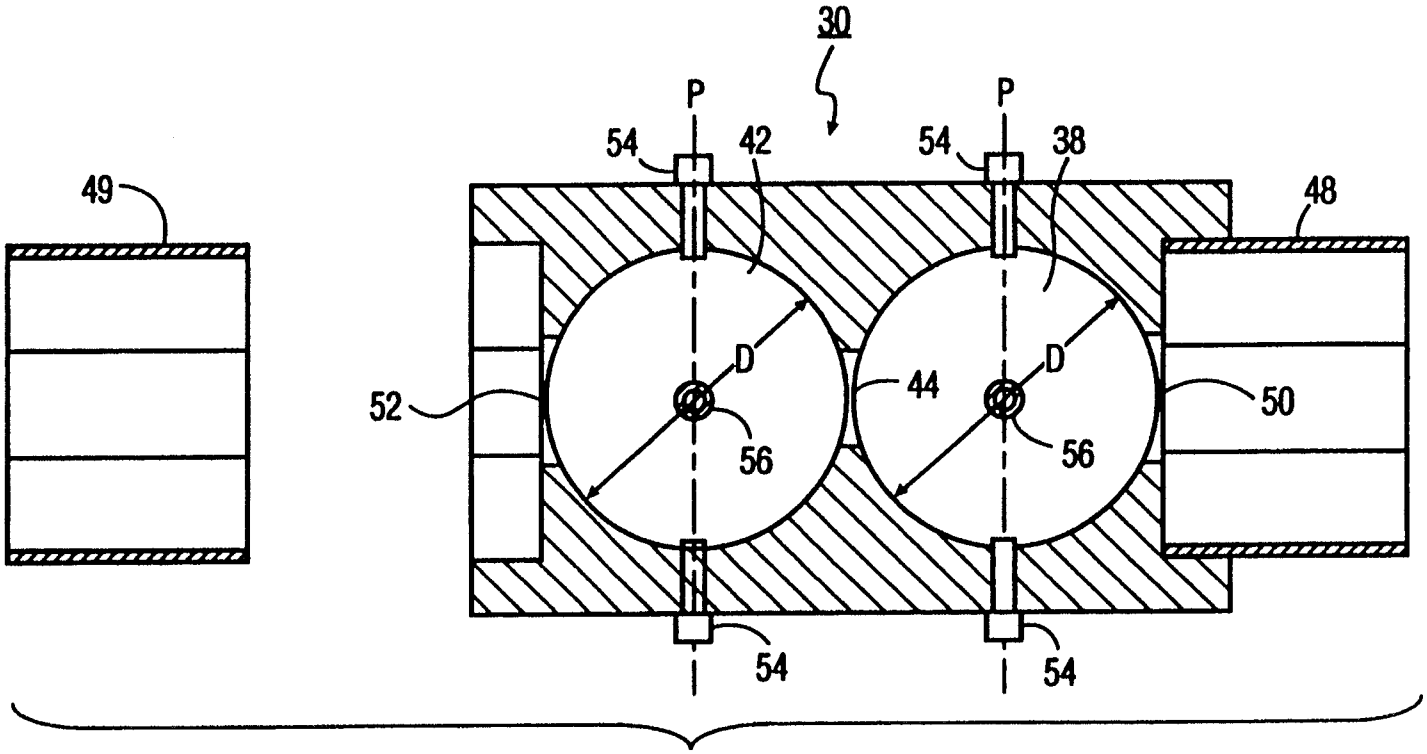
FIG. 5 is a sectioned side plan view of the present invention two section microwave filter.
Figure 6:
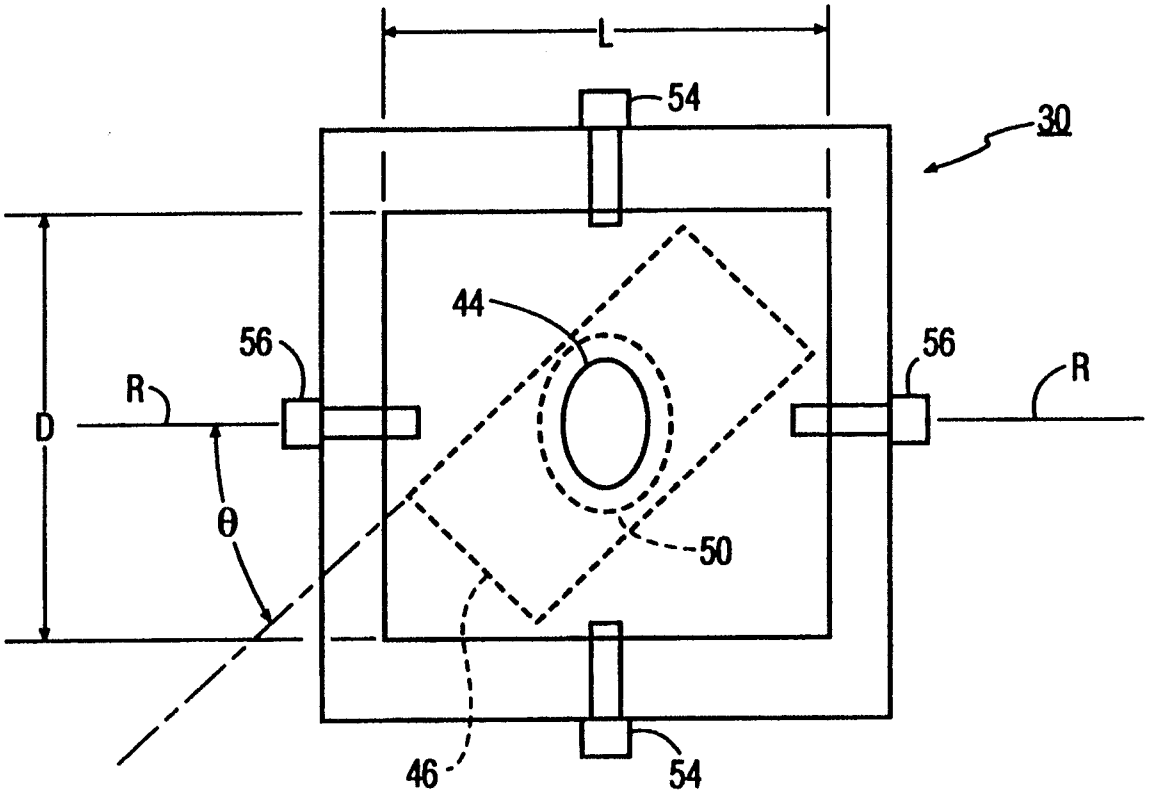
FIG. 6 is a sectional view of the present invention two section microwave filter.

Referring to FIGS. 5 and 6 in conjunction with FIG. 4, it can be seen that the filter 30 contains the two resonator cavities 38, 42, wherein each of the cavities has an internal diameter D, a length L, and a midpoint line P. Tuning plungers 54, 56 are spaced at approximately 90 degree intervals around the midpoint P of each cavity 38, 42. As is well known in the art, tuning plungers 54, 56 enable the adjustment of the resonant frequencies within the cavities 38, 42. As illustrated, the filter 30 consists of two cavities 38, 42. However, it will be understood that the use of two cavities is exemplary and any number of resonant cavities may be used within the filter 30. The dual bandpass response of the filter 30 is achieved by utilizing the $TE_{1,1,1}$ and $TM_{0,1,0}$ modes in the right circular cylindrical cavities 38, 42. These modes are orthogonal and do not couple to each other, thus there is no power transfer from one mode to the other mode.

The length L and the diameter D of the cavities 38, 42 determine the frequency response for the filter 30. For the $TM_{0,1,0}$ mode, the resonant frequency is determined only by the diameter D of the cavity. In other words, the resonant frequency of the $TM_{0,1,0}$ mode is independent of the cavity length L. On the other hand, the resonant frequency of the $TE_{1,1,1}$ mode is dependent on both the diameter D and the length L of the cavity. When fabricating the dual bandpass filter 30, the cavity diameter D is selected so that the $TM_{0,1,0,}$ mode resonates at one of the desired frequencies. The length L of the cavity is then determined by the second desired frequency. In this way, the filter 30 has two passbands in a desired frequency band. Selection of the dimensions for the diameter D and the length L, in order to achieve a desired resonant frequency, would be well known to an individual who is skilled in the art of microwave filter design. In order to utilize the $TM_{0,1,0}$ and the $TE_{1,1,1}$ modes so that no other modes will be present within the filter, the length L and diameter D must be appropriately chosen. It will be understood that while only two independent modes are present in the described embodiment, that other dimensional variations in the resonant cavities may produce additional modes.

FIGS. 5 and 6 illustrates that input coupling aperture 50 and the output coupling aperture 52 are located centrally within the input end 34 and output end 36 of the filter 30, respectively. Similarly, the interstage aperture 44 is positioned in approximately the middle of the center wall 40. Also it can be clearly seen that the tuning plungers 54, 56 are positioned at approximately 90 degree intervals about the mid-point P of each cavity. The two tuning plungers 54 in each cavity 38, 42 are located diametrically across from one another to provide a tuning adjustment for one of the modes, which in this case is the TE mode. In a similar manner, the other tuning plungers 56 of each cavity 38, 42, are symmetrically located in the center of the end caps of the circular cavities 38, 42. This set of tuning plungers 56 adjusts the TM mode frequency. Thus, the tuning plungers 54, 56 allow for trimming the resonant frequencies of each mode of each cavity. This, or some other type of tuning mechanism is necessary for most practical narrow band microwave filters in order to accommodate manufacturing tolerances.

Referring to FIG. 6, there is shown a sectional view through the input end 34 of the dual bandpass microwave filter 30 according to the present invention. The figure depicts the orientation of the waveguide port 46 at $\theta=45°$ from the axis R of the cylindrical cavity 38, and the elliptical input aperture 50 and the elliptical interstage aperture 44 required to produce equal loaded Qs for both frequencies. The ratio of the coupling apertures 50, 52 to the interstage apertures 44 is determined by the desired bandpass ripple of the filter. While the filter 30 is shown with elliptical apertures, it will be understood that other shaped apertures may be included to produce like filtering characteristics.

Referring to FIGS. 3–6 in conjunction with one another, one can see that RF energy which is transmitted through the waveguide 48 will enter the filter 30 through the input coupling aperture 50. The RF energy then enters the first cavity 38 which resonates in two independent orthogonal modes. The two cavities 38, 42 are coupled together to provide a desired filtering capacity. The intercavity coupling is provided by the interstage aperture 44 which transfers energy between identical modes in the coupled cavities 38, 42.

Orientation of the waveguide 48 at the input end 34 of the filter is critical for the dual mode operation. By orienting the broad wall 47 of the waveguide at an angle $\theta$ ($0<\theta<90°$) with respect to the axis R of the cylindrical resonator cavities 38, 42, both the TE and TM modes will be excited in the resonator. In the described configuration of the filter 30, the two modes are uncoupled and so the electric and magnetic fields are orthogonal at all points within the cavities. Uncoupled modes have no transfer of power from one mode to another within the cavity. In this way, two independent passbands can be established within the filter 30. The filtered RF energy will exit the second cavity 42 through the output coupling aperture 52. The filtered energy will then be transferred into an outgoing waveguide structure 49. The outgoing waveguide 49 will be oriented in line with the incoming waveguide 48 in order to receive energy from both of the excited modes. As mentioned previously, the two resonant frequencies will be determined by the length L and diameter D of the cavities 38, 42. Additional cavity sections can be added to the basic design of the filter 30 in order to further refine and modify the passbands for the two resonant frequencies.

The dual bandpass microwave filter is especially useful for filtering two frequencies which are generated from a single source. The capability to produce two passbands from a single structure reduces the cost and effort of manufacturing. Such a design eliminates the critical path lengths which were required in conventionally designed multi-passband filters.

Figure 7:
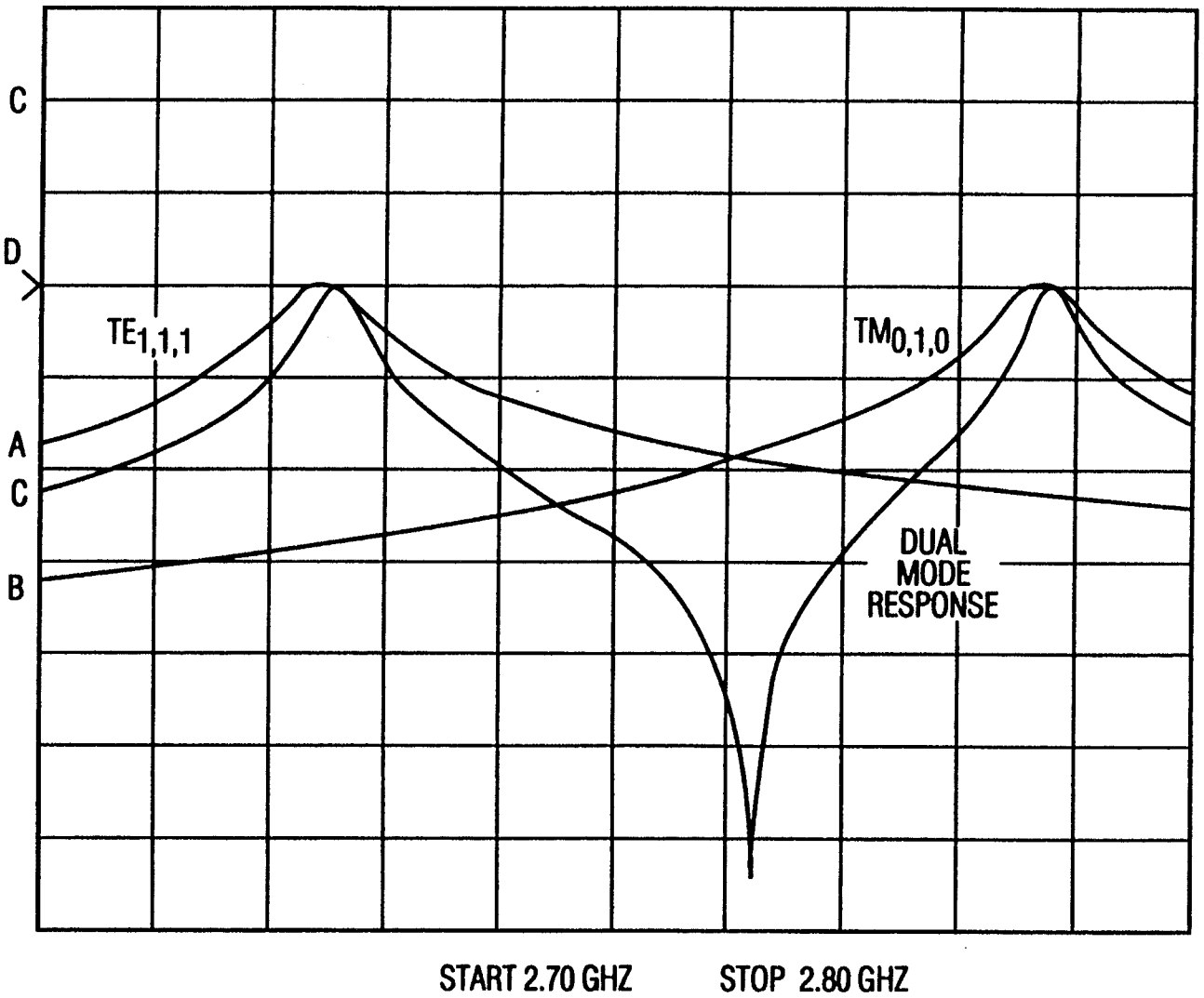
FIG. 7 is a graph showing the frequency response of a one section filter in accordance with the present invention. The graph shows the individual response of each mode, as well as the dual mode operation.

The performance of a dual bandpass filter has been demonstrated using an S-band resonator that was fabricated to mate with a WR284 waveguide. FIG. 7 shows the frequency response of a single resonator cavity in the 2.7–2.8 GHz range for the individual modes as well as the dual mode response. Waves A and B illustrate the frequency response for the $TE_{1,1,1}$ and $TM_{0,1,0}$ modes, respectively. The frequency responses of waves A and B were produced by orienting the waveguide 48 so that only the respective individual modes were excited. The response of wave A resulted when the broad wall 47 of the waveguide 48 was parallel to the axis R of the resonator cavity 38, so that only the $TE_{1,1,1}$ mode is excited. Here, a single passband is located at approximately 2.724 GHz. The response of wave B resulted when the broad wall 47 of the waveguide 48 was perpendicular to the axis R of the resonator so that only the $TM_{0,1,0}$ mode is excited. Wave B shows a passband centered at approximately 2.787 GHz. The frequency response of wave C was produced by orienting the broad wall 47 of the waveguide 48 at a 45 degree angle in order to cause the dual mode excitation. One can see that the two passbands in the dual mode response are located at approximately 2.725 GHz and 2.788 GHz.

Figure 8:
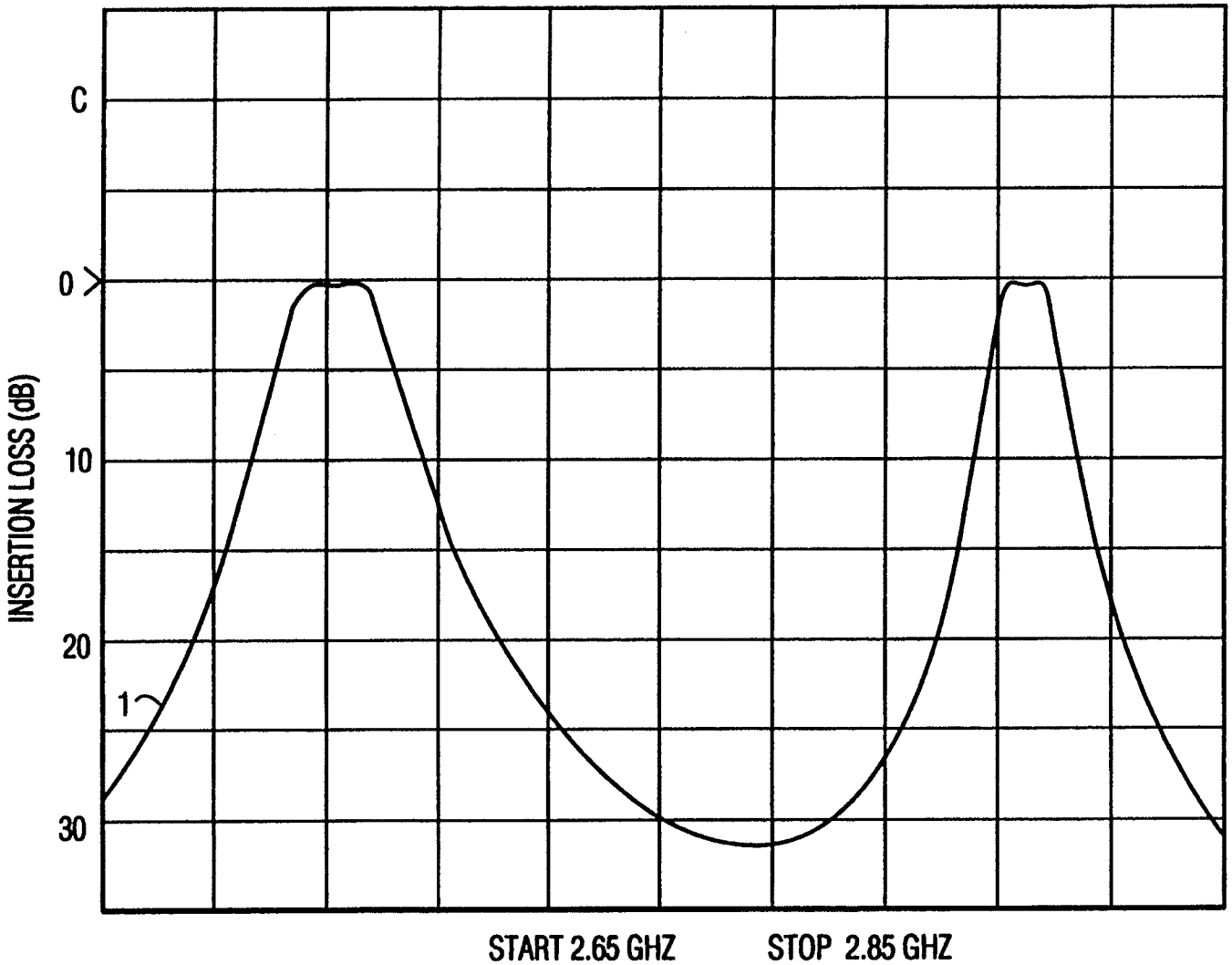
FIG. 8 is a graph showing the frequency response of a two section filter in accordance with the present invention.

The performance of the dual mode filter 30 is also demonstrated in FIG. 8, which is a graph of the response of the two section dual mode filter 30, wherein the waveguides 48, 49 were oriented at an angle $\theta$ of 45°, and circular coupling apertures 50, 52 were employed. Thus, the bandwidth of the TE mode was greater than the bandwidth of the TM mode. Equal bandwidths can be obtained through the use of elliptical apertures. Steeper skirts can be obtained by using additional dual mode filter sections.

Figure 9:
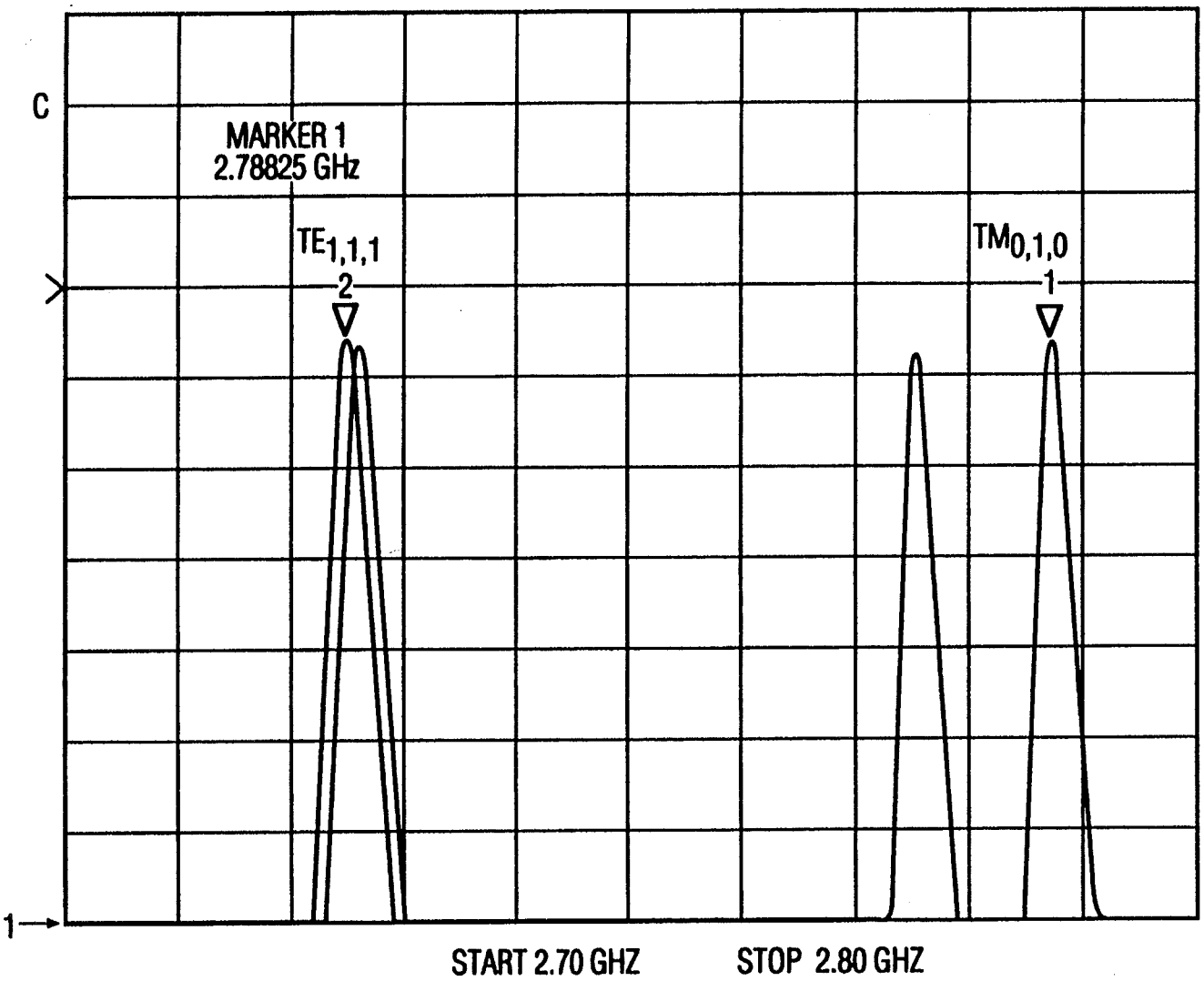
FIG. 9 is a graph showing the frequency response of a single dual mode cavity of the two section filter for the $TE_{1,1,1}$ mode and the $TM_{0,1,0}$ mode after TM mode tuning.
Figure 10:
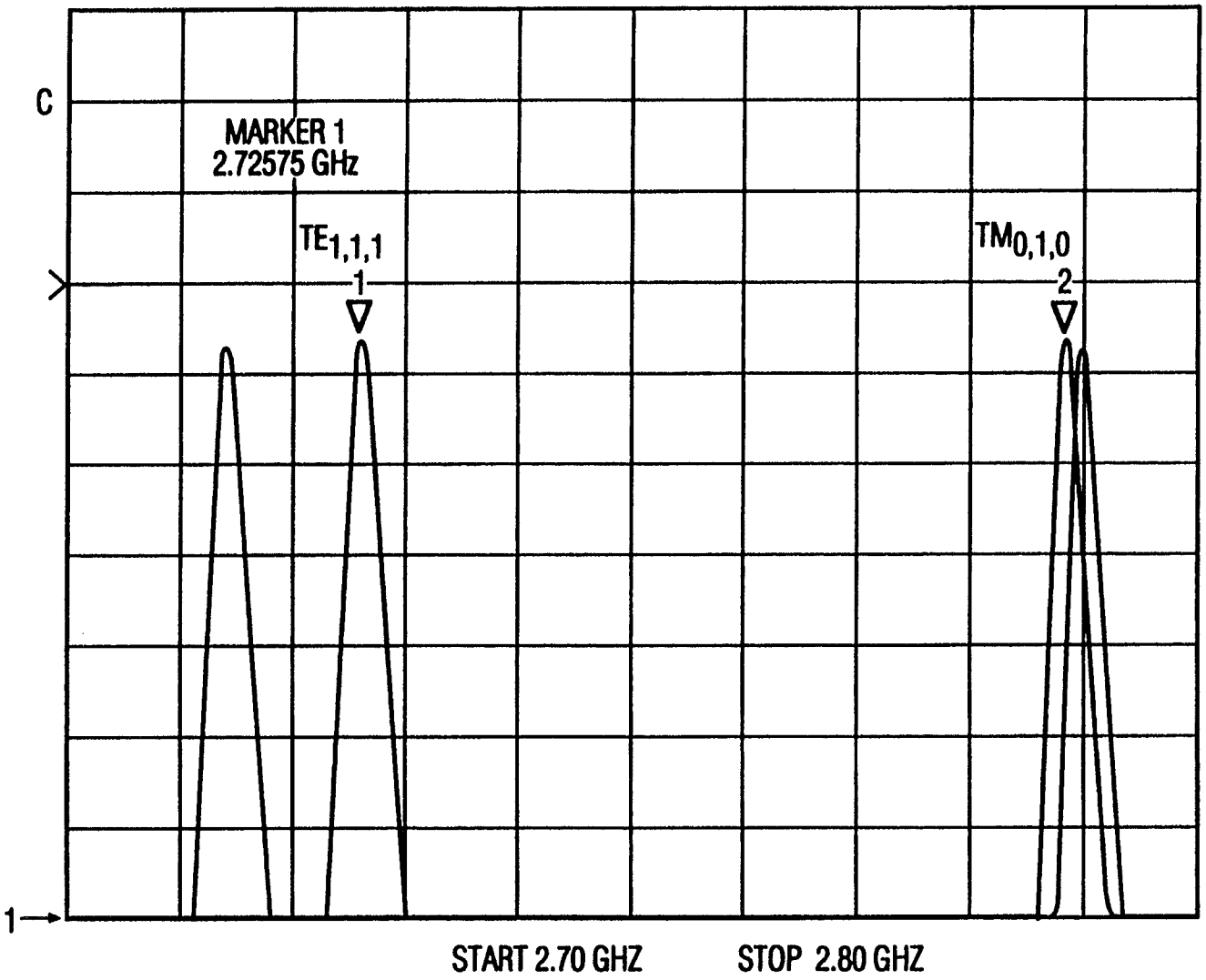
FIG. 10 is a graph showing the frequency response of a single dual mode cavity of the two section filter for the $TE_{1,1,1}$ mode and the $TM_{0,1,0}$ mode after TE mode tuning.

Most practical narrow band filters need some method of trimming the resonant frequency to accommodate manufacturing tolerances. In the dual mode filter 30 as described, nearly independent frequency adjustment can be realized with tuning plungers 54, 56. Referring to FIG. 9, the dual mode response of the two passbands in a single resonator cavity is shown before and after TM mode tuning. Using markers 1 and 2 as "before tuning" references, one can see that the TM mode resonant frequency can be lowered by 12 MHz through the use of the tuning plunger 56. This tuning adjustment of the TM mode, as can be seen from marker 2, causes only a 1 MHz variation in the TE mode. FIG. 10 illustrates similar independent tuning characteristics for the TE mode using tuning plungers 54. As can be seen from marker 1, the TE mode resonant frequency can be lowered by 12 MHz while the resonant frequency of the TM mode, as seen from marker 2 is only increased by 1 MHz.

While the filter 30 described in FIGS. 3–6 employs right circular cylindrical cavities 38, 42 for resonating the $TE_{1,1,1}$ and $TM_{0,1,0}$ modes, it will be understood that rectangular or other shaped cavities can be used with equivalent modes, for example the $TE_{1,0,1}$ and $TM_{1,1,1}$ modes in square waveguide.

The dual bandpass microwave filters described herein may be fabricated from highly conductive metallic materials. The actual material used depends upon the temperature sensitivity of the device and the system in which it will be employed. Commonly used materials used in fabrication include brass, aluminum, and Invar.

Thus, the present invention discloses a dual mode passband microwave filter which is capable of filtering two resonant frequencies in a desired frequency band. The device uses dual modes in a single structure resonator to produce the two passbands. The cavity loaded Qs are independently adjustable, so the two passbands can have the same or different bandwidths, the same of different amplitude ripples, and the same or different phase responses. By using a single structure to achieve such filtering, the manufacturing efforts and associated costs are greatly reduced. The new filter design eliminates many of the critical microwave paths associated with conventional designs, which were required to have exact phase lengths.

It will be understood that the embodiments described herein are merely exemplary and that a person skilled in the art may make many variations and modifications to the described embodiment utilizing functionally equivalent components, dimensions and materials. More specifically, it should be understood that various shaped resonator cavities and various shaped waveguides may be used in conjunction with one another. Similarly, the coupling apertures will be shaped in accordance with bandwidth and mode requirements. All such variations and modifications are intended to be included within the scope of this invention as defined by the appended claims.

What is claimed is:

1. A microwave passband filter having first and second passbands, said filter comprising:

input and output waveguide means for propagating a band of microwave frequencies; and filter means coupled to said input and output waveguide means, said filter means resonating at a first microwave frequency in a first electromagnetic mode and a second microwave frequency in a second electromagnetic mode, said first and second filter passbands determined by said first and second resonant frequencies, whereby only those frequencies within said filter passbands can propagate within said output waveguide.

2. The filter of claim 1, wherein said first electromagnetic mode is a transverse electric (TE) mode and said second electromagnetic mode is a transverse magnetic (TM) mode.

3. The filter of claim 2, wherein said filter means and said waveguide means are disposed about a common longitudinal axis, said waveguide means being oriented about said longitudinal axis at an angle of inclination with respect to said filter means, thereby producing coupling variations to said first and second microwave frequencies.

4. The filter of claim 3, wherein said angle of inclination of said waveguide means is chosen to excite both said TE mode and said TM mode.

5. The filter of claim 4, wherein said angle of inclination is 45 degrees.

6. The filter of claim 1, wherein said filter includes at least one resonant cavity capable of supporting orthogonal electromagnetic modes.

7. The filter of claim 6, wherein each said resonant cavity includes a first port and a second port for transfer of energy into and out of said cavity.

8. The filter of claim 6, including a plurality of resonant cavities, wherein each of said cavities resonates in two orthogonal modes to produce two pass bands within a specified frequency band.

9. The filter of claim 8, wherein each said mode in said resonant cavities is separately adjustable to adjust said first microwave frequency and said second microwave frequency.

10. The filter of claim 9, including tuning means to separately adjust said first and second microwave frequency in each said resonant cavity.

11. The filter of claim 2, wherein said TE mode is a $TE_{1,1,1}$ mode and said TM mode is a $TM_{0,1,0}$ mode in a cylindrical cavity.

12. The filter of claim 2, wherein said TE mode is a $TE_{1,0,1}$ mode and said TM mode is a $TM_{1,1,1}$ mode in a cavity of predetermined shape.

13. The filter of claim 8, wherein each said resonant cavity has has a quality factor (Q) associated therewith, said Q of each said resonant cavity being independently adjustable.

14. The filter of claim 1, wherein said filter is an S-band microwave filter.

15. The filter of claim 6, wherein each said cavity is dimensioned to resonate at said first microwave frequency and said second microwave frequency.

16. A dual passband microwave filter comprising:

input and output waveguide means; and filter means coupled to said waveguide means, said filter means including a plurality of resonating cavities disposed therein, each of said cavities resonating at first and second microwave frequencies in orthogonal TE and TM modes respectively, said waveguide means being oriented at an angle of inclination relative said filter means in order to excite said TE and TM modes, and said cavities being tunable to said first and second microwave frequencies to produce a first passband at said first microwave frequency and a second passband at said second microwave frequency.

17. The filter of claim 16, wherein said cavities are dimensioned and shaped to resonate at said first and second microwave frequencies.

18. The filter of claim 16, wherein each said mode in said resonant cavities is separately tunable to adjust said first and second microwave frequencies.

19. The filter of claim 16, wherein the RF energy associated with each of said TE and TM modes is substantially equal.

20. A microwave passband filter having separate filter passbands, said filter comprising:

input and output waveguide means for propagating a band of microwave frequencies; and filter means coupled to said input and output waveguide means, said filter means resonating at a first microwave frequency in a first electromagnetic mode and a second microwave frequency in a second electromagnetic mode, said filter passbands determined by said first and second resonant frequencies, whereby only those frequencies within said filter passbands can propagate within said output waveguide, said filter means and said waveguide means being disposed about a common longitudinal axis, and said waveguide means being oriented about said longitudinal axis at an angle of inclination with respect to said filter means, thereby producing coupling variations to said first and second microwave frequencies.

* * * * *